US011434723B2

(12) United States Patent
Frost et al.

(10) Patent No.: US 11,434,723 B2
(45) Date of Patent: Sep. 6, 2022

(54) SAND LIFT TOOL, SYSTEM AND METHOD

(71) Applicant: ODESSA SEPARATOR, INC., Odessa, TX (US)

(72) Inventors: Cavin Bert Frost, Odessa, TX (US); Daniel L. Culbertson, Odessa, TX (US); Gustavo A. Gonzalez-Cabrera, Midland, TX (US); Mark H. Lowe, Odessa, TX (US)

(73) Assignee: Odessa Separator, Inc., Odessa, TX (US)

( * ) Notice: Subject to any disclaimer, the term of this patent is extended or adjusted under 35 U.S.C. 154(b) by 71 days.

(21) Appl. No.: 17/150,028

(22) Filed: Jan. 15, 2021

(65) Prior Publication Data

US 2021/0230974 A1 Jul. 29, 2021

Related U.S. Application Data

(60) Provisional application No. 62/965,431, filed on Jan. 24, 2020.

(51) Int. Cl.

| | |
|---|---|
| ***E21B 43/08*** | (2006.01) |
| ***E21B 43/38*** | (2006.01) |
| ***E21B 37/08*** | (2006.01) |
| ***E21B 34/14*** | (2006.01) |
| ***E21B 43/02*** | (2006.01) |

(52) U.S. Cl.
CPC ..... *E21B 34/142* (2020.05); *E21B 43/025* (2013.01); *E21B 43/08* (2013.01)

(58) Field of Classification Search
CPC ..... E21B 27/005; E21B 43/08; E21B 43/082; E21B 43/084; E21B 43/086; E21B 43/088; E21B 43/38; E21B 37/08; E21B 43/121; E21B 43/128
See application file for complete search history.

(56) References Cited

U.S. PATENT DOCUMENTS 1,342,813 A * 6/1920 Huston ..... E21B 43/082
166/158
1,431,006 A * 10/1922 Kelsey ..... F04B 47/005
166/105.3
4,407,360 A 10/1983 Hamrick
(Continued)

OTHER PUBLICATIONS

Machine translation of the abstract of Indonesian publication No. 2017/S/00160, published Mar. 3, 2017, 1 page.
(Continued)

*Primary Examiner* — Kipp C Wallace
(74) *Attorney, Agent, or Firm* — Smith IP Services, P.C.

(57) ABSTRACT

A sand lift tool for use in a subterranean well can include an outer housing, an inner production tube positioned in the outer housing, and a dart received in the inner production tube. An annulus is positioned between the outer housing and the inner production tube. The dart can reciprocate in the inner production tube in response to variations in fluid flow between the annulus and an interior of the inner production tube. Another sand lift tool can include an outer housing, an inner production tube, and a sand collection annulus between the outer housing and the inner production tube. A flow area for fluid flow between the annulus and an interior of the inner production tube increases in response to an increase in a flow rate of the fluid flow.

23 Claims, 6 Drawing Sheets

(56) References Cited

U.S. PATENT DOCUMENTS

| | | | | |
|---|---|---|---|---|
| 5,168,765 | A * | 12/1992 | Broussard | E21B 7/26 175/21 |
| 5,295,537 | A | 3/1994 | Trainer | |
| 6,167,960 | B1 | 1/2001 | Moya | |
| 6,216,788 | B1 | 4/2001 | Wilson | |
| 6,330,915 | B1 | 12/2001 | Moya | |
| 6,571,869 | B1 * | 6/2003 | Pluchek | E21B 37/00 166/105.3 |
| 7,195,070 | B2 * | 3/2007 | Delaloye | E21B 37/06 166/310 |
| 7,610,957 | B2 | 11/2009 | Davis et al. | |
| 7,779,901 | B2 | 8/2010 | Davis et al. | |
| 8,257,585 | B2 | 9/2012 | Davis et al. | |
| 8,336,617 | B2 | 12/2012 | Knobloch et al. | |
| 8,651,181 | B2 | 2/2014 | Knobloch et al. | |
| 9,441,435 | B2 * | 9/2016 | Leitch | E21B 43/121 |
| 10,012,047 | B1 | 7/2018 | Alley et al. | |
| 10,030,485 | B2 | 7/2018 | Gourmelon | |
| 10,082,014 | B2 * | 9/2018 | Fielder, III | E21B 43/128 |
| 10,132,151 | B2 | 11/2018 | Leitch | |
| 10,132,152 | B2 | 11/2018 | Leitch | |
| 10,465,493 | B2 | 11/2019 | Mills | |
| 10,487,639 | B2 | 11/2019 | Webber | |
| 10,900,483 | B2 * | 1/2021 | Stachowiak, Jr. | E21B 43/126 |
| 2002/0166665 | A1 * | 11/2002 | Vincent | E21B 34/063 166/291 |
| 2012/0298369 | A1 * | 11/2012 | Knobloch, Jr | E21B 21/103 166/99 |
| 2018/0112503 | A1 * | 4/2018 | Lane | E21B 43/126 |
| 2019/0353005 | A1 * | 11/2019 | Gaudette | E21B 43/08 |
| 2020/0362668 | A1 * | 11/2020 | Fripp | E21B 34/14 |

OTHER PUBLICATIONS

Natasia Zenia; "Sand Trapper", abstract of Indonesian patent application No. S00201608228, patent announcement date Mar. 3, 2017, 1 page.

Halliburton; "SandRight Solids Fallback Preventer", company article No. H012656, dated Aug. 2017, 2 pages.

Borets; "SandTrapper", company brochure, prior to Jan. 2020, 2 pages.

* cited by examiner

SAND LIFT TOOL, SYSTEM AND METHOD

CROSS-REFERENCE TO RELATED APPLICATION

The present application claims the benefit of the filing date of U.S. provisional application No. 62/965,431 filed on 24 Jan. 2020. The entire disclosure of the prior application is incorporated herein by this reference.

BACKGROUND

This disclosure relates generally to equipment utilized and operations performed in conjunction with a subterranean well and, in examples described below, more particularly provides a sand lift tool and associated system and method.

Sand can accumulate in well equipment when fluids are produced from a subterranean well. For this reason, it is common practice to use well screens in an attempt to exclude sand from production tubing strings used to produce the fluids to surface. However, it is practically impossible to exclude all of the sand from the interior of a production tubing string.

Therefore, it will be appreciated that improvements are continually needed in the art of protecting well equipment from sand accumulation in production tubing. It is one of the objectives of the present disclosure to provide such improvements to the art.

DETAILED DESCRIPTION

Figure 1:
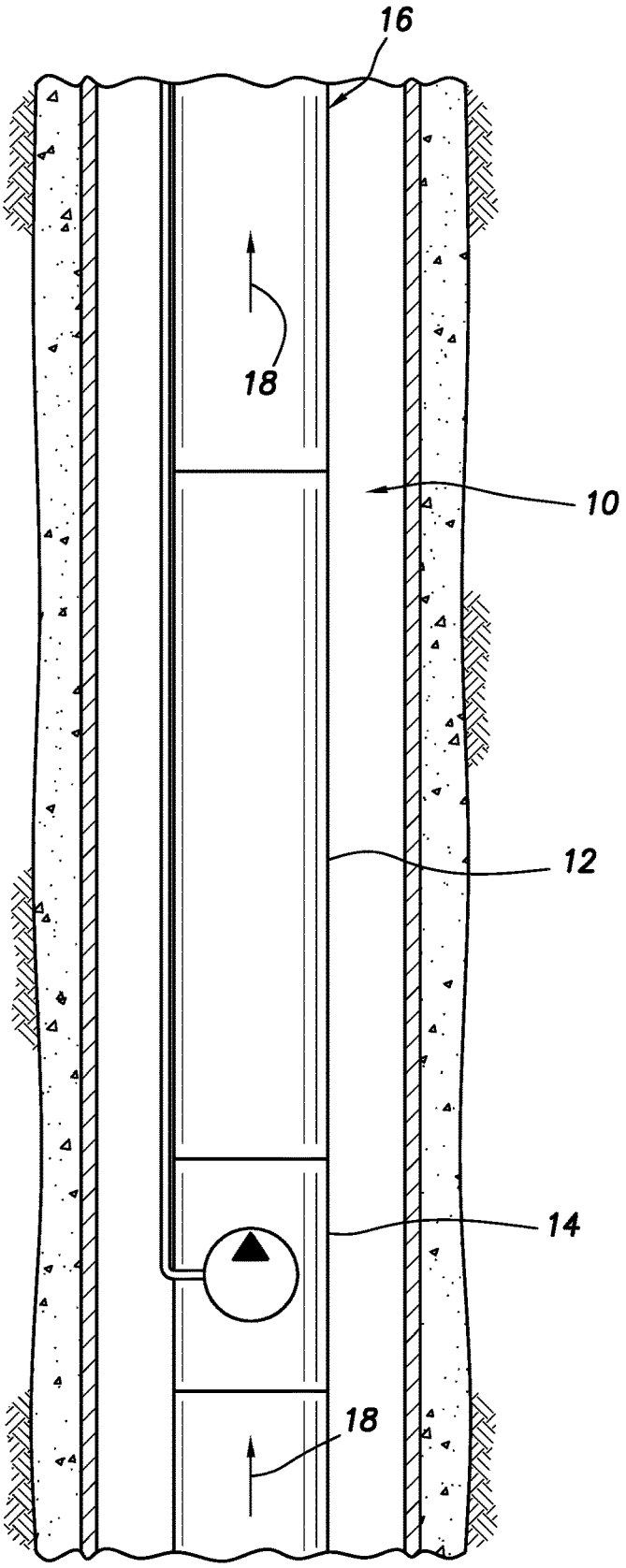
FIG. 1 is a representative partially cross-sectional view of an example of a well system and associated method which can embody principles of this disclosure.

Representatively illustrated in the accompanying drawings is a sand lift tool, system and associated method which can embody principles of this disclosure. However, it should be clearly understood that the tool, system and method are merely one example of an application of the principles of this disclosure in practice, and a wide variety of other examples are possible. Therefore, the scope of this disclosure is not limited at all to the details of the tool, system and method example described herein and/or depicted in the drawings.

A wide array of tools, chemical treatments and techniques exist to alleviate problems experienced in well bores throughout the petroleum industry. Many of these tools and treatments provide their benefit below a well's pump. Tools such as sand screens, centrifugal de-sanders, gas separators, chemical treatment tools and other solutions do their work to keep the well producing.

Electric submersible pumps (ESP's) are often used in high volume wells because they are efficient in pumping large quantities of fluid. The pump moves the well bore fluid upward through a tubing string to be produced to the surface.

One issue that is not remedied by these products and techniques occurs as sand is produced upward within the tubing along with the well bore fluid. This is due to agitation and velocity of the fluid as it is pumped up the tubing causing the sand to be suspended within the fluid. When the pump cycles off, the suspended sand falls downward and accumulates on top of, and in, the pump.

Depending on the quantity of sand within the fluid, the sand may become so impacted in the pump that the pump will no longer function due to failure of the motor or in some cases, breaking the pump shaft or other internal components. In addition, the accumulated sand prevents a chemical treatment from being pumped from surface through the pump. The sand lift tool described herein is utilized above the pump and provides a unique method of solving these problems.

Dimensions noted herein are to offer clarity of proportional size. This disclosure is not limited to the noted dimensions. Tools may be of larger or smaller size.

In one example, the sand lift tool consists of a large (4") tubular outer housing which is reduced on each end to a smaller diameter on each end (2⅞"). A lower connection is attached to a discharge connection of a pump below. An upper connection attaches to tubing above. An inner production tube (1¼"×20') is fixed within the tubular outer housing. This inner tube is comprised of columnar vee wire screen.

Since the fluid flow direction is from inside the inner production tube-to-outside the production tube, the vee wire column may be configured in reverse to typical screen which is configured for use at an intake point. This allows for reduced plugging of openings (slots) as sand laden fluid is expelled through them.

The openings (slots) in the vee wire screen of the inner production tube may be of varying dimensions to accommodate different production rates and tool dimensions. In another example, the inner production tube may be comprised of a solid pipe with slotted or various other shaped openings.

The top of the inner production tube is enclosed within a bullnose which includes slotted or inclined ports. Within the inner production tube is a free moving "dart" which can travel up or down depending on fluid flow.

In some examples, a bumper assembly is affixed in place inside the bullnose at the top of the inner production tube. The bumper assembly consists of an upper cap, a lower plate and a spring connected between the cap and the lower plate. The bumper assembly serves to absorb shock as the dart is forced upward by fluid pressure when the pump is active.

A bottom of the inner production tube contains a base on which the dart rests when there is insufficient fluid flow to propel the dart upward. Both the bull nose and the lower dart base contain openings which allow for unrestricted fluid flow once sand is cleared. This provides increased flow as not all the fluid must pass through the screen to exit the tool.

When the pump is cycled off, the dart falls to the bottom of the inner production tube. Once the pump is activated, fluid is forced to move upward within the inner production tube. This will push the dart upward.

Fluid is forced out through the screen and into an annulus between the large tubular outer housing and the inner production tube. Sand particles may accumulate within this annulus allowing continued fluid flow up the inner production tube.

The action caused by movement of the dart forces fluid through the screen at a high velocity, agitating any sand which has accumulated in the annulus and flushing the screen openings (slots) keeping them clear. Due to agitation and velocity of the fluid, solid particles are suspended in the fluid and are able to be produced to the surface, clearing the sand in the annulus.

By clearing the tool of sand in each pump cycle, sand does not accumulate over time as it does in typical ESP systems. This protects the pump from damage and increases run times between expensive well workover events.

Multiple sand lift tools may be installed one above another in any length needed, with a single dart operating through the entire string. In another configuration, separate sand lift tools may be installed at varying locations within the tubing to offer additional stages of sand clearing. In wells with higher levels of sand content, placing these "booster" tools will work to keep sand suspended as fluid is moved to the surface.

Referring now to FIG. 1, an example of a system 10 for use with a subterranean well is representatively illustrated. In this example, a sand lift tool 12 is used to protect an electric submersible pump 14 from sand accumulation in a tubing string 16. The tubing string 16 is generally vertical as depicted in FIG. 1, but in other examples the tubing string could be inclined from vertical.

The pump 14 is used to produce fluid 18 from the well. When the pump 14 is activated, the fluid 18 is flowed upward to surface through the tubing string 16. When the pump 14 is deactivated, the flow of the fluid 18 ceases and any sand or other debris in the tubing string 16 above the pump 14 could settle onto the pump, if the sand lift tool 12 were not present in the tubing string.

The sand lift tool 12 performs its "sand lift" function by stirring up any sand that has accumulated in the sand lift tool, so that the sand is produced to the surface with the fluid 18. The sand is stirred up in the sand lift tool 12 when the pump 14 is activated to flow the fluid 18 upward through the sand lift tool and the remainder of the tubing string 16 extending to the surface.

Figure 2:
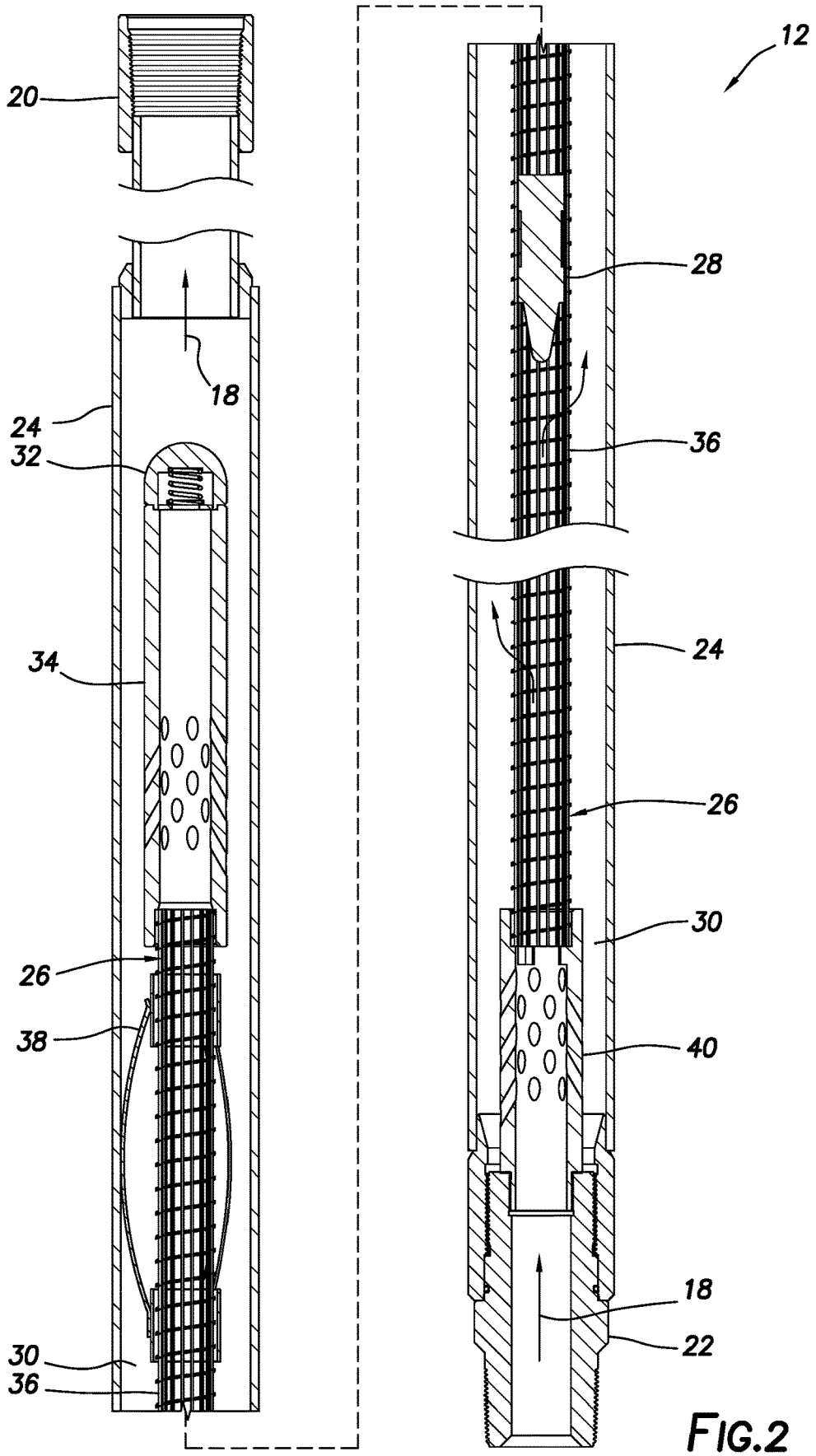
FIG. 2 is a representative cross-sectional view of an example of a sand lift tool that may be used in the FIG. 1 system and method.

Referring additionally now to FIG. 2, a cross-sectional view of an example of the sand lift tool 12 is representatively illustrated. The FIG. 2 sand lift tool 12 may be used with the system 10 and method of FIG. 1, or it may be used with other systems and methods. For convenience, the sand lift tool 12 is described below as it may be used in the FIG. 1 system 10 and method.

In the FIG. 2 example, the sand lift tool 12 includes an upper connector 20, a lower connector 22, an outer housing 24, an inner production tube 26 and a dart 28. In other examples, the sand lift tool 12 could include more or fewer components, or different combinations of components. Thus, the scope of this disclosure is not limited to the specific details of the sand lift tool 12 as depicted in the drawings or described herein.

The upper connector 20 in this example is configured for connection to the tubing string 16 extending to the surface. The lower connector 22 in this example is configured for connection to the pump 14. Thus, the flow of the fluid 18 from the pump 14 enters the sand lift tool 12 via the lower connector 22 and exits the sand lift tool via the upper connector 20.

The outer housing 24 extends between and connects the upper and lower connectors 20, 22. The outer housing 24 surrounds the inner production tube 26, so that a sand collection annulus 30 is formed between the outer housing and the inner production tube. When the flow of the fluid 18 ceases (e.g., when the pump 14 is deactivated), sand can accumulate in the annulus 30 and can pass into the screen 36.

The inner production tube 26 in this example includes an upper impact absorber 32, an upper housing 34, a screen 36, a centralizer 38 and a base housing 40. The dart 28 is able to reciprocate in an interior of the inner production tube 26 between the upper impact absorber 32 and the base housing 40. The dart 28 is biased to displace downward by gravity, and is biased to displace upward by the flow of the fluid 18 when the pump 14 is activated.

As depicted in FIG. 2, the fluid 18 is flowing upward through the sand lift tool 12. The fluid 18 flows into the lower connector 22, into the interior of the inner production tube 26, into the annulus 30, and then upward and out of the sand lift tool 12 via the upper connector 20.

This flow of the fluid 18 from the interior of the inner production tube 26 to the annulus 30 pushes the dart 28 upward. However, when the flow of the fluid 18 ceases, the dart 28 will descend in the inner production tube 26, until it engages a shoulder in the base housing 40, as described more fully below.

Figure 3:
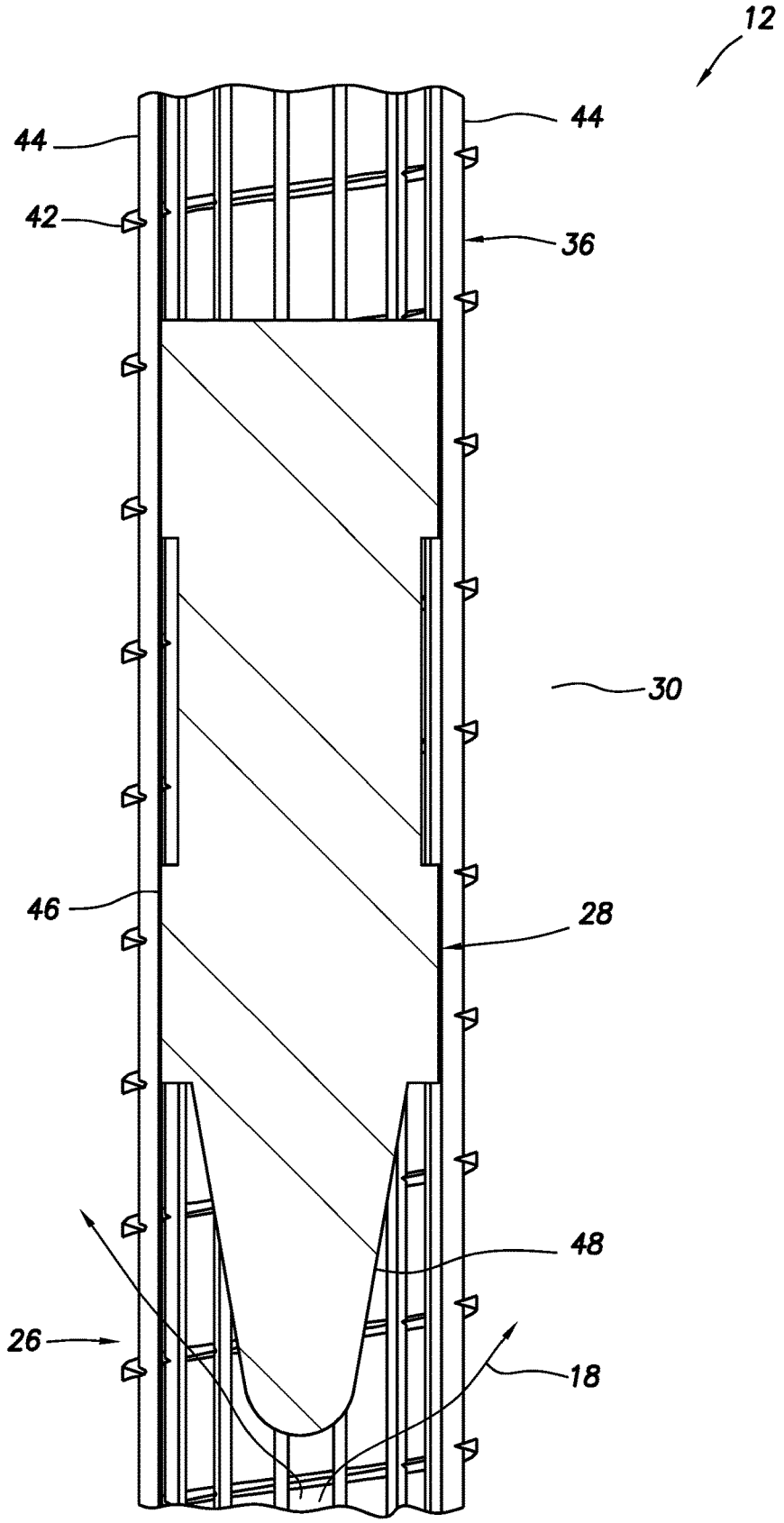
FIG. 3 is a representative cross-sectional view of an example of a reciprocating dart in an inner production tube of the sand lift tool.

Referring additionally now to FIG. 3, a cross-sectional view of an example of the dart 28 in the inner production tube 26 is representatively illustrated. In other examples, other types of darts and other types of inner production tubes may be used, and so it should be clearly understood that the scope of this disclosure is not limited to the details of the dart 28 or the inner production tube 26 as depicted in the drawings or described herein.

In the FIG. 3 example, the screen 36 includes a "V"-shaped cross-section wire 42 wrapped helically about multiple longitudinally extending rods 44. The wire 42 can be welded to each of the rods 44 in the manner of a conventional well screen. The rods 44 are circumferentially distributed about the dart 28 and the interior of the inner production tube 26.

A longitudinal spacing between adjacent wraps of the wire 42 can be varied as desired to provide for regulation of sand and other debris into and out of the interior of the inner production tube 26, to provide for sufficient flow of the fluid 18 from the interior of the inner production tube to the annulus 30, or for other purposes. For clarity of illustration, the spacing between the adjacent wraps of the wire 42 are depicted in FIG. 3 as being relatively large compared to a conventional well screen, but any spacing may be used in keeping with the principles of this disclosure.

Note that it is not necessary for a screen to be used as a component of the inner production tube 26. For example, a tube with holes, slots, perforations or other openings could be used instead of the screen 36. Thus, the scope of this disclosure is not limited to use of the screen 36 or any other component of the inner production tube 26.

In the FIG. 3 example, the dart 28 has a body 46 that is generally cylindrical in shape. However, a downwardly facing nose 48 of the dart 28 has a generally conical shape that increases in cross-sectional area in an upward direction. The conical shape of the nose 48 deflects the fluid 18 radially outward from the interior of the inner production tube 26 toward the annulus 30. This radially outward and upward flow through the annulus 30 stirs up any accumulated sand or other debris in the annulus, allowing it to be produced with the fluid 18 to the surface.

Figure 4:
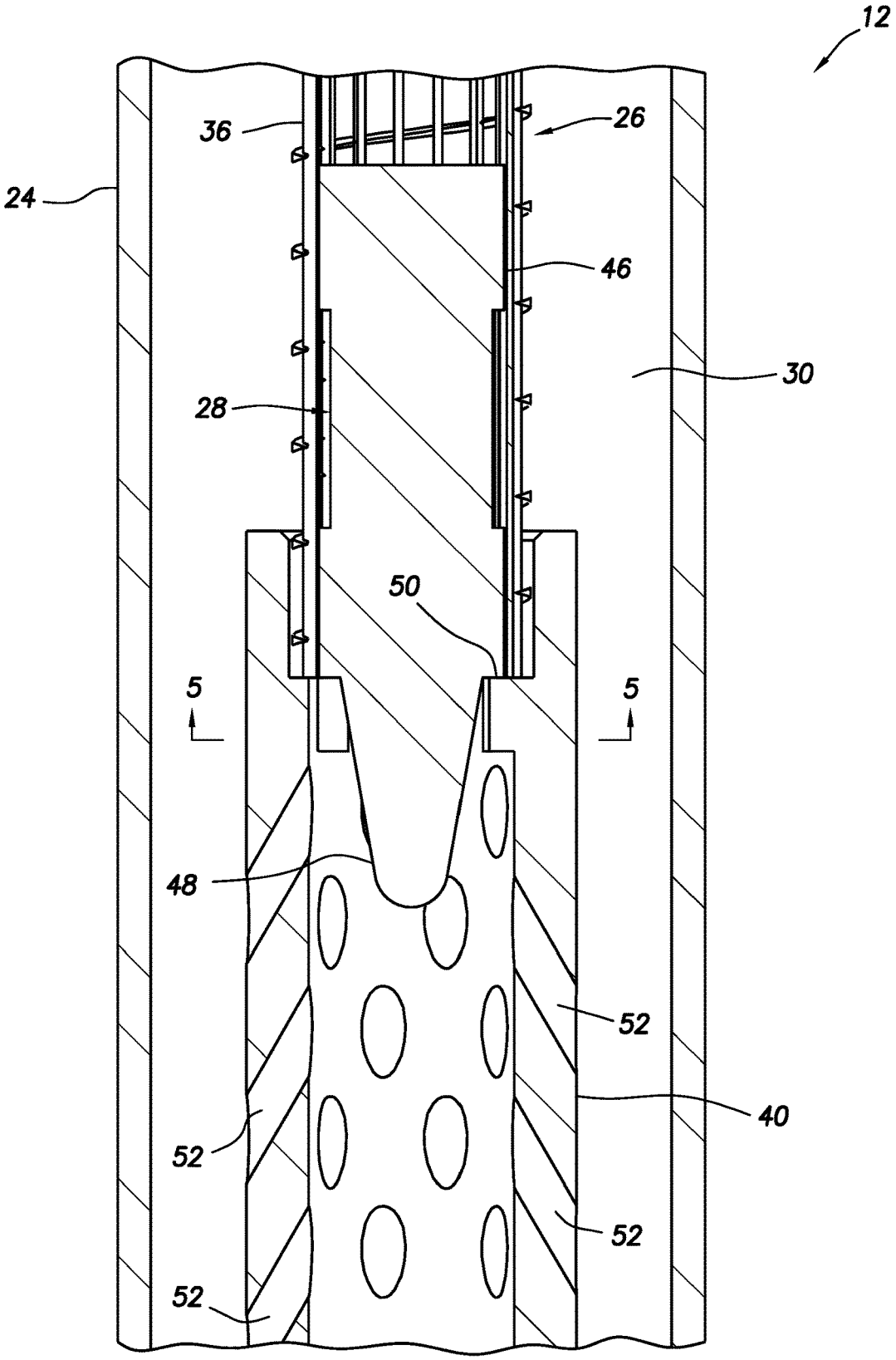
FIG. 4 is a cross-sectional view of the dart at a lowermost position thereof.

Referring additionally now to FIG. 4, a cross-sectional view of a portion of the sand lift tool 12 is representatively illustrated. In this view, the flow of the fluid 18 has ceased, and so the dart 28 has descended in the inner production tube 26 to its lowermost position.

Downward displacement of the dart 28 is limited by a shoulder 50 formed in the base housing 40. Note that this engagement between the dart 28 and the shoulder 50 does not prevent flow of the fluid 18 in any direction through the inner production tube 26, as described more fully below. Thus, contact between the dart 28 and the shoulder 50 does not prevent the fluid 18 and entrained solids (e.g., sand, debris, etc.) from passing downwardly through the base housing 40 and lower connector 22 to the pump 14, but the downward flow of the fluid and entrained solids is thereby regulated.

In the FIG. 4 example, the base housing 40 has multiple inclined ports 52 formed through a wall thereof. The ports 52 are angled downward in an outward direction.

This orientation of the ports 52 has at least two benefits—any sand that accumulates in the annulus 30 up to a level of the ports 52 is restricted from flowing upwardly through the ports into the interior of the inner production tube 26 when the pump 14 is deactivated, and the fluid 18 will be directed by the ports 52 to flow toward the lower end of the annulus 30 (and will thereby stir up any sand that has accumulated at the lower end of the annulus) when the pump 14 is activated. However, the scope of this disclosure is not limited to any particular direction or orientation of the ports 52 or to use of the ports in the base housing 40 at all.

Figure 5:
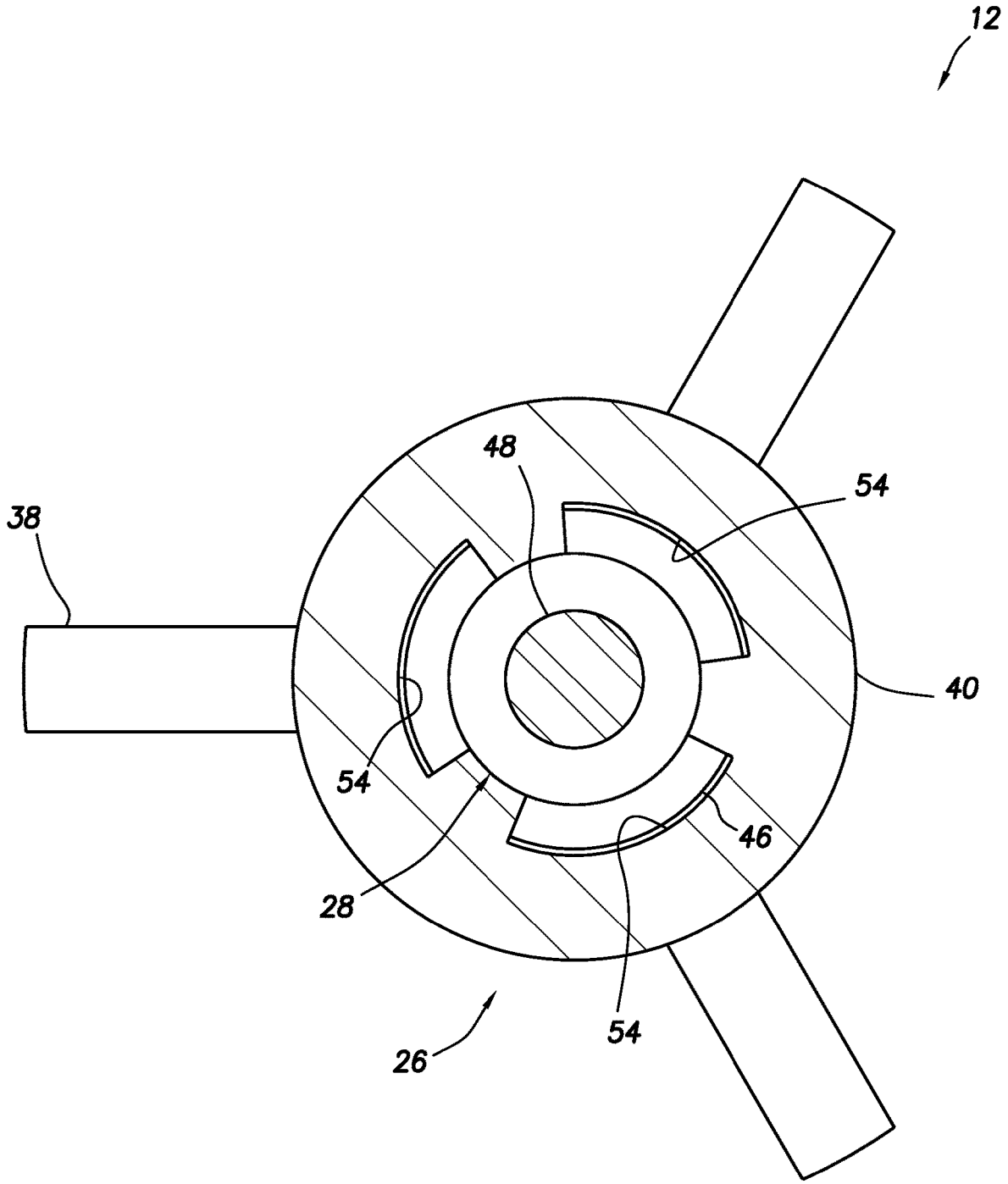
FIG. 5 is a cross-sectional view of an example of a base housing of the inner production tube, taken along line 5-5 of FIG. 4.

Referring additionally now to FIG. 5, a cross-sectional view of the dart 28 and the base housing 40 is representatively illustrated, taken along line 5-5 of FIG. 4. In this view, the manner in which flow through the interior of the inner production tube 26 is still permitted, even when the dart 28 is engaged with the shoulder 50 in the base housing 40, can be seen.

As depicted in FIG. 5, multiple gaps or recesses 54 are formed into the shoulder 50 (see FIG. 4), so that the body 46 of the dart 28 cannot seal off against or sealingly engage the shoulder. Thus, flow is always permitted through the interior of the inner production tube 26, even when the dart 28 is at its lowermost position.

Figure 6:
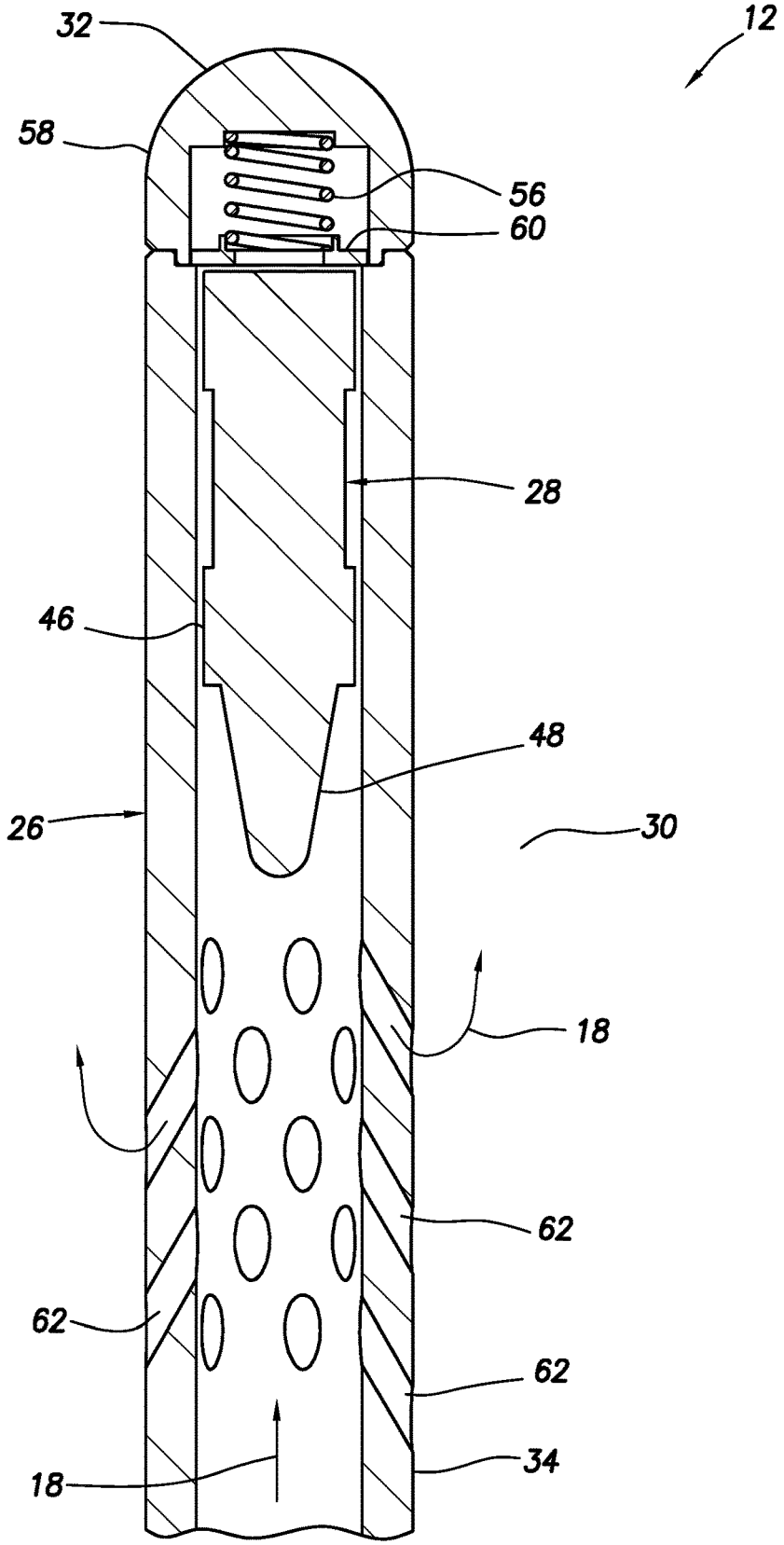
FIG. 6 is a cross-sectional view of the dart at an uppermost position thereof.

Referring additionally now to FIG. 6, a cross-sectional view of the dart 28 at its uppermost position in the inner production tube 26 is representatively illustrated. In this view, the fluid 18 is flowing at a sufficient flow rate to bias the dart 28 all the way to the upper end of the interior of the inner production tube 26.

As the dart 28 ascends in the inner production tube 26 in response to the increase in the flow rate of the fluid 18, a flow area through the screen 36 for fluid 18 flow to the annulus 30 from an interior of the inner production tube 26 increases.

To prevent damage that might occur to the inner production tube 26 or the dart 28 due to impact of the dart against the upper end of the interior of the inner production tube, the impact absorber 32 is connected at an upper end of the upper housing 34. In this example, the impact absorber 32 includes a biasing device 56 (such as, a coiled spring, an elastomer, a compressible gas, etc.) positioned longitudinally between an upper cap 58 and an abutment plate 60.

The plate 60 is configured to engage the dart 28 and to be deflected upward against the biasing force exerted by the biasing device 56 when the dart displaces to the upper end of the inner production tube 26. In this manner, the kinetic energy of the dart 28 is more gradually converted into potential energy in the compressed biasing device 56, so that damage to the dart and the inner production tube 26 is avoided.

Multiple inclined ports 62 are formed through a wall of the upper housing 34. The ports 62 are angled downward in an outward direction, similar to the ports 52 in the base housing 40 described above.

Note that the dart 28 in its FIG. 6 uppermost position does not obstruct any of the ports 62 in the upper housing 34. Instead, the dart 28 is positioned in a tubular portion of the upper housing 34 longitudinally between the ports 62 and the impact absorber 32.

It may now be fully appreciated that this disclosure provides significant advancements to the art of protecting well equipment from sand accumulation in production tubing. The sand lift tool 12 is uniquely configured to stir up any sand accumulation in the tubing string 16 when the fluid 18 flows upwardly through the tubing string, and to allow back flow through the pump 14 when the fluid flows downwardly through the tubing string.

One problem in artificial lift operations is handling solids during production. During shut down, sand in the production stream falls back onto the pump 14 and creates a solid plug in the pump, thereby causing a failure when the pump is turned back on. This failure is costly to operators. Operators need a solution to be able to back spin the pump 14 and treat through the pump with chemicals from the surface.

The sand lift tool 12 does not stop sand above the pump 14, but regulates the rate of sand going back into the pump when the pump is shut down. This reduces plugging and allows for chemical treatment from the surface through the pump.

When the pump 14 turns on, the differential pressure created by the pump pushes the dart 28 off of the base housing 40 and into the upper housing 34. Fluid 18 and entrained solids flow through the screen 36 to the surface.

When the pump 14 is turned off, the dart 28 falls back to the base housing 40. Fluid 18 and entrained solids begin to flow back through the screen 36 in a reverse direction (as compared to when the pump is turned on). The dart 28 and the screen 36 regulate the rate of fluid and solids flow back through the pump 14. Because the sand lift tool 12 has no seal, an operator can chemically treat through the pump 14 from the surface and use back spin of the pump impeller to clear obstructions from the pump.

When the pump 14 is turned back on, the centrifugal force of the impeller creates turbulence, which lifts the fluid 18 and entrained solids up though the screen 36 to the surface.

In one example, a sand lift tool 12 for use in a subterranean well can include an outer housing 24, and an inner production tube 26 positioned in the outer housing 24. An annulus 30 is positioned between the outer housing 24 and the inner production tube 26. A dart 28 is received in the inner production tube 26. The dart 28 can reciprocate in the inner production tube 26 in response to variations in fluid 18 flow between the annulus 30 and an interior of the inner production tube 26.

The inner production tube 26 may include a screen 36. The screen 36 can comprise a wire 42 wrapped about multiple longitudinally extending rods 44.

The inner production tube 26 may include a base housing 40 and multiple inclined ports 52 formed through a wall of the base housing 40. The base housing 40 may be connected to a lower end of a screen 36.

A shoulder 50 formed in the base housing 40 may limit downward displacement of the dart 28 through the inner production tube 26. Fluid 18 flow between the dart 28 and the shoulder 50 may be permitted when the dart 28 is engaged with the shoulder 50.

The dart 28 may displace upward in the inner production tube 26 in response to the fluid 18 flow from the interior of the inner production tube 26 to the annulus 30. The dart 28 may displace downward in the inner production tube 26 when the fluid 18 flow ceases. Downward fluid flow through the inner production tube may be permitted when the dart 28 is at its lowermost position in the inner production tube 26.

The inner production tube 26 may include an upper impact absorber 32 configured to limit upward displacement of the dart 28. The upper impact absorber 32 may comprise a biasing device 56 positioned between an abutment plate 60 and an upper cap 58 of the inner production tube 26.

The inner production tube 26 may include an upper housing 34 connected to a screen 36, and multiple inclined ports 62 formed through a wall of the upper housing 34. The dart 28 may be positioned in the upper housing 34 longitudinally between the upper impact absorber 32 and the ports 62 when the dart 28 is at an upper limit of displacement in the inner production tube 26.

In another example, a sand lift tool 12 for use with a subterranean well can comprise: an outer housing 24, an inner production tube 26 and a sand collection annulus 30 between the outer housing 24 and the inner production tube 26. A flow area for fluid 18 flow between the annulus 30 and an interior of the inner production tube 26 increases in response to an increase in a flow rate of the fluid 18 flow.

The sand lift tool 12 may include a dart 28 positioned in the interior of the inner production tube 26. The dart 28 may displace upward in response to the increase in the flow rate of the fluid 18 flow. The dart 28 may displace downward in the inner production tube 26 when the fluid 18 flow ceases.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A sand lift tool for use in a subterranean well, the sand lift tool comprising:

an outer housing configured to be installed above a downhole pump;

an inner production tube positioned in the outer housing, whereby an annulus is positioned between the outer housing and the inner production tube, in which the inner production tube comprises a sand screening member; and a dart received in the inner production tube, in which the dart is configured to reciprocate along at least a majority of a total length of the inner production tube in response to variations in fluid flow from the downhole pump, whereby an available area below the dart for fluid flow between the inner production tube and the ann ulus via the sand screening member increases as the dart displaces upwardly through the inner production tube, and whereby an available area above the dart for fluid flow between the inner production tube and the annulus via the sand screening member decreases as the dart displaces upwardly through the inner production tube.

2. The sand lift tool of claim 1, in which the sand screening member comprises a screen.

3. The sand lift tool of claim 2, in which the screen comprises a wire wrapped about multiple longitudinally extending rods.

4. The sand lift tool of claim 1, in which the inner production tube comprises a base housing and multiple inclined ports formed through a wall of the base housing.

5. The sand lift tool of claim 4, in which the base housing is connected to a lower end of the sand screening member.

6. The sand lift tool of claim 4, in which a shoulder formed in the base housing limits downward displacement of the dart through the inner production tube, and in which fluid flow between the dart and the shoulder is permitted when the dart is engaged with the shoulder.

7. The sand lift tool of claim 1, in which the dart displaces upward in the inner production tube in response to the fluid flow from the downhole pump, and in which the dart displaces downward in the inner production tube when the fluid flow ceases.

8. The sand lift tool of claim 7, in which the dart does not prevent fluid flow through the inner production tube when the dart is at a lowermost position in the inner production tube.

9. The sand lift tool of claim 1, in which the inner production tube comprises an upper impact absorber configured to limit upward displacement of the dart.

10. The sand lift tool of claim 9, in which the upper impact absorber comprises a biasing device positioned between an abutment plate and an upper cap of the inner production tube.

11. The sand lift tool of claim 9, in which the inner production tube comprises an upper housing connected to the sand screening member, and multiple inclined ports formed through a wall of the upper housing, and in which the dart is positioned in the upper housing longitudinally between the upper impact absorber and the ports when the dart is at an upper limit of displacement in the inner production tube.

12. A sand lift tool for use with a subterranean well, the sand lift tool comprising:

an outer housing configured to be installed above a downhole pump;

an inner production tube having an upper end and a lower end defining a length there between, and a sand screening member along the length;

an annulus between the outer housing and the inner production tube; and a dart received in the inner production tube, in which downward fluid flow through the inner production tube is permitted when the dart is at a lowermost position in the inner production tube, the dart being configured to travel along at least a majority of the length of the inner production tube in response to activation of the downhole pump.

13. The sand lift tool of claim 12, in which a flow area for fluid flow between the annulus and an interior of the inner production tube increases in response to an increase in a flow rate of the fluid flow.

14. The sand lift tool of claim 13, in which the dart displaces upward in response to the increase in the flow rate of the fluid flow.

15. The sand lift tool of claim 13, in which the dart displaces downward in the inner production tube when the fluid flow ceases.

16. The sand lift tool of claim 13, in which the inner production tube comprises an upper impact absorber configured to limit upward displacement of the dart.

17. The sand lift tool of claim 16, in which the upper impact absorber comprises a biasing device positioned between an abutment plate and an upper cap of the inner production tube.

18. The sand lift tool of claim 13, in which the inner production tube comprises an upper housing connected to the sand screening member, and multiple inclined ports formed through a wall of the upper housing, and in which the dart is positioned in the upper housing longitudinally between the upper impact absorber and the ports when the dart is at an upper limit of displacement in the inner production tube.

19. The sand lift tool of claim 12, in which the sand screening member comprises a screen.

20. The sand lift tool of claim 19, in which the screen comprises a wire wrapped about multiple longitudinally extending rods.

21. The sand lift tool of claim 12, in which the inner production tube comprises a base housing and multiple inclined ports formed through a wall of the base housing.

22. The sand lift tool of claim 21, in which the base housing is connected to a lower end of the sand screening member.

23. The sand lift tool of claim 21, in which a shoulder formed in the base housing limits downward displacement of a dart through the inner production tube, and in which fluid flow between the dart and the shoulder is permitted when the dart is engaged with the shoulder.

* * * * *